US007699621B2

(12) United States Patent
Zhang

(10) Patent No.: US 7,699,621 B2
(45) Date of Patent: Apr. 20, 2010

(54) ELECTRICAL CARD CONNECTOR WITH CONTACTS HAVING PRELOAD PORTIONS

(75) Inventor: Han-Ming Zhang, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/287,463

(22) Filed: Oct. 8, 2008

(65) Prior Publication Data

US 2009/0093165 A1 Apr. 9, 2009

(30) Foreign Application Priority Data

Oct. 8, 2007 (TW) ..... 96216787 A

(51) Int. Cl.
*H01R 12/00* (2006.01)

(52) U.S. Cl. ..... 439/74

(58) Field of Classification Search ..... 439/74, 439/66, 65, 81, 82, 83, 660
See application file for complete search history.

(56) References Cited

U.S. PATENT DOCUMENTS

| | | | | |
|---|---|---|---|---|
| 6,196,883 | B1 * | 3/2001 | Bechaz et al. | 439/789 |
| 6,231,394 | B1 * | 5/2001 | Schnell et al. | 439/630 |
| 6,984,130 | B2 * | 1/2006 | Richter et al. | 439/66 |
| 6,994,566 | B2 * | 2/2006 | You | 439/66 |

* cited by examiner

*Primary Examiner*—Chandrika Prasad
(74) *Attorney, Agent, or Firm*—Ming Chieh Chang; Wei Te Chung; Andrew C. Cheng

(57) ABSTRACT

An electrical card connector comprising an insulative housing 4 and a plurality of contacts 5 which received in the insulative housing, each contact 5 includes a retention portion 51, an elastic portion 52 which extends from one end of the retention portion 51, a contact portion 53 which connects with the elastic portion 52, a preload portion 54 which extends from the end of the contact portion 53 and a soldering portion 55, wherein the contact 5 further includes a connect portion 56 which extends from the soldering portion 55 and a block portion 57 which extends from the end of the connect portion 56.

11 Claims, 3 Drawing Sheets

ELECTRICAL CARD CONNECTOR WITH CONTACTS HAVING PRELOAD PORTIONS

BACKGROUND OF THE INVENTION

1. Field of the Invention

The present invention relates to card connector, especially to a card connector contact with pre-load so as to securely ensure a prepressing sustained thereon.

2. Background of the Invention

Electrical cards are known in the art and contain intelligence in the form of a memory circuit or other electronic program. Some form of card reader retrieve the information or data stored on the card. Such cards are used in many applications in today's electronic society, including video cameras, digital still cameras, smart phones, PDAs, music players, ATMs, cable television decoders, toys, games, PC adapters, multi-media cards and other electronic applications, etc.

Example of prior art card-receiving connectors of U.S. Pat. No. 6,231,394B comprises an insulative housing and a plurality of contacts received in the insulative housing. The said contact includes a soldering portion, a connect portion, a retention portion, an elastic portion, a contact portion and a crossbeam. The soldering portion and the retention portion are connected by the connect portion, the elastic portion extends from one end of the retention portion and connect with the contact portion, the crossbeam protrudes and extends from the end of the contact portion. A block portion is set on the insulative housing to support the crossbeam.

Unfortunately, problems continue to be encountered with the electrical card connectors mentioned above. The contact portion can bring an upward prepressing through the block portion, when the prepressing becomes bigger, the insulative housing would warp and become deformed. Therefore, an improved electrical card connector is desired to overcome the disadvantages of the prior arts.

SUMMARY OF THE INVENTION

An object, therefore, of the invention is to provide a new and improved electrical card connector of the character described able to prevent the deformation of the insulative housing.

In order to achieve the object set forth, an electrical connector in accordance with the present invention comprises an insulative housing and a plurality of contacts which received in the insulative housing, each contact includes a retention portion, an elastic portion which extends from one end of the retention portion, a contact portion which connects with the elastic portion, a preload portion which extends from the end of the contact portion and a soldering portion, wherein the contact further includes a connect portion which extends from the soldering portion and a block portion which extends from the end of the connect portion.

As disclosed herein, the preload portion which defined on the connect portion locates lower than the block portion so as to prevent the deformation of the insulative housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
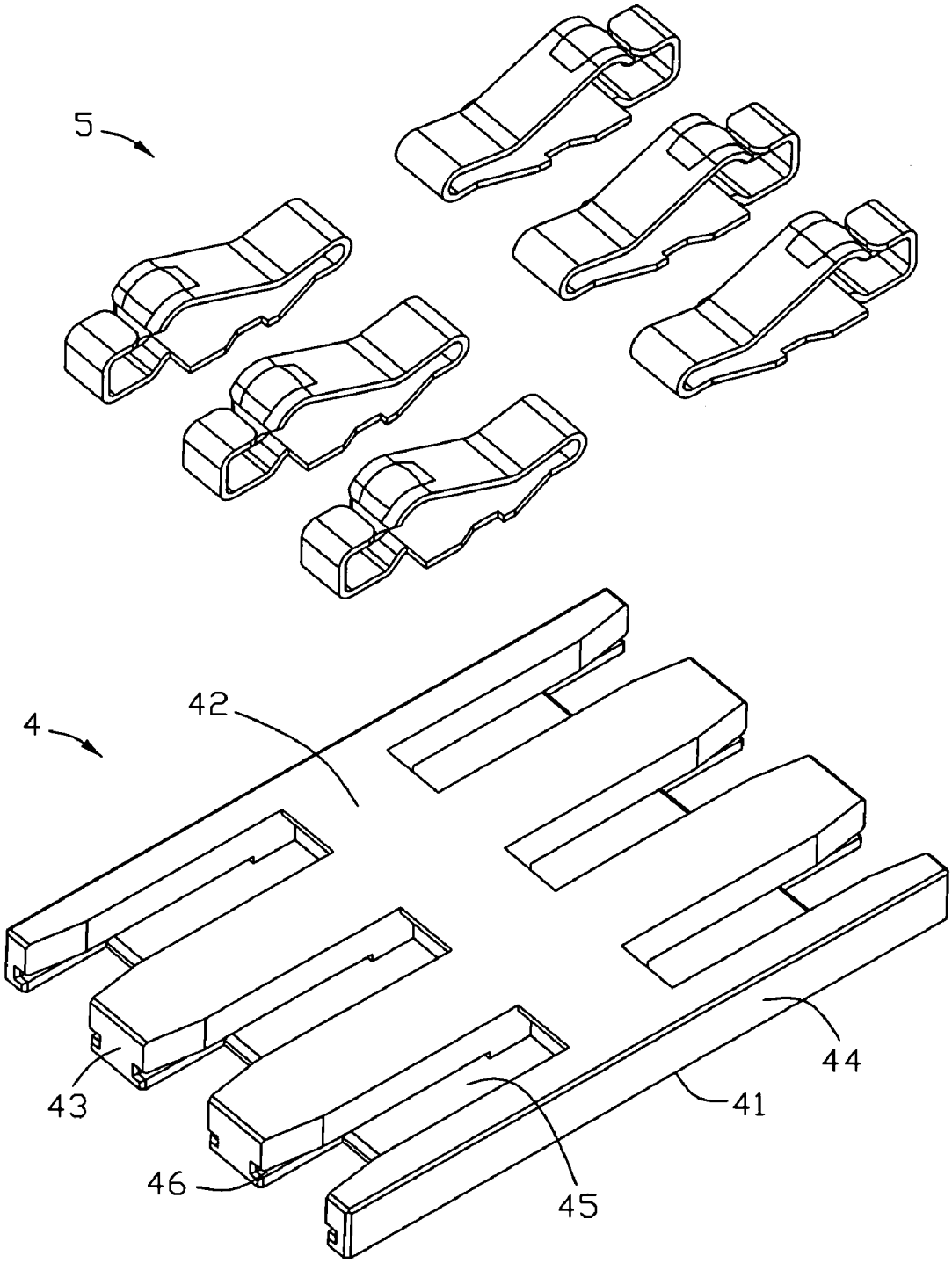
FIG. 1 is an exploded view of an electrical card connector embodying the concepts of the invention.
Figure 2:
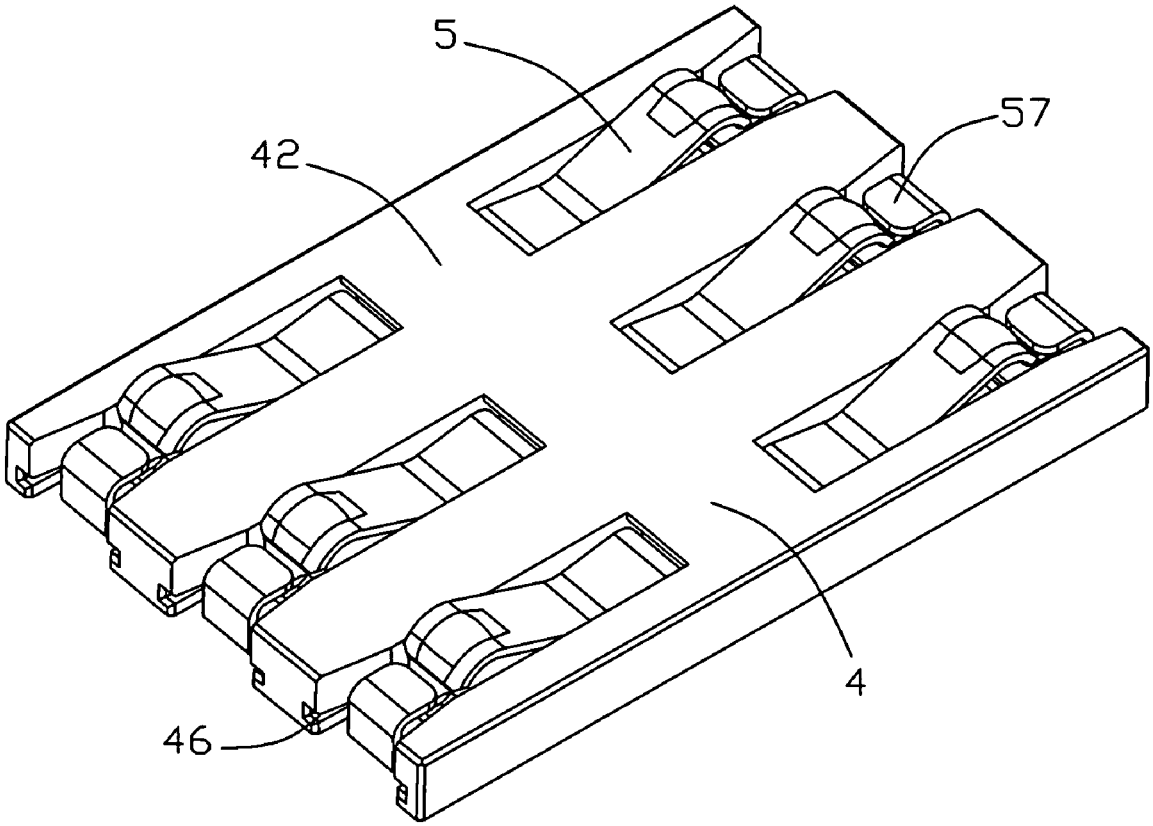
FIG. 2 is an assembled perspective view of the electrical card connector shown in FIG. 1.
Figure 3:
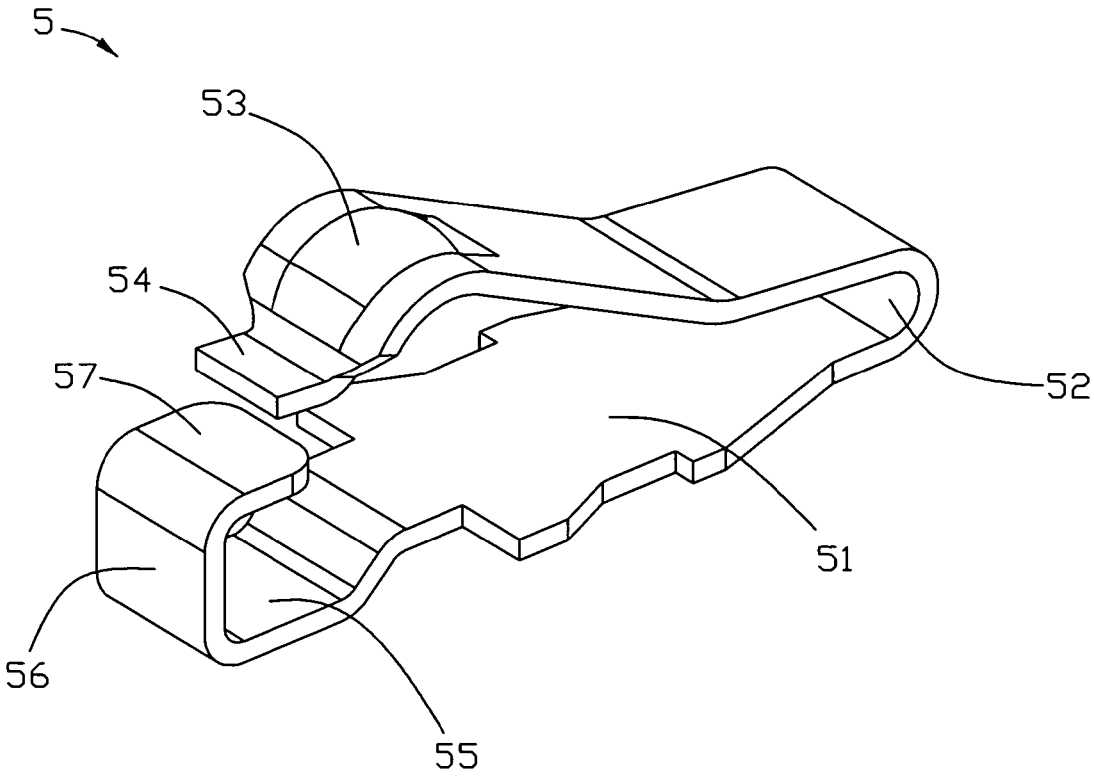
FIG. 3 is a perspective view of the contact of the electrical card connector shown in FIG. 1.

Referring to FIGS. 1-3, an electrical card connector 100 for connecting an electrical card (not shown) to a circuit board (not shown) in accordance with the preferred embodiment of the present invention comprises an insulative housing 4, a plurality of contacts 5 received in the insulative housing 4.

The insulative housing 4 is in a form of rectangular, including an assembly surface 41, a contact surface 42 which is opposite to the assembly surface 41, a first end surface 43 and a second end surface 44 which connect the assembly surface 41 and the contact surface 42. A plurality of passageways 45 are set on the insulative housing 4 symmetrically for receiving the corresponding contact 5. The retention slots 46 are formed on the two inner sides of the passageways 45.

The contacts 5 are made of metal sheet, each contact 5 includes a retention portion 51, an elastic portion 52 which bends and extends from one end of the retention portion 51, a contact portion 53 connected with the elastic portion 52, a preload portion 54 extends from the end of the contact portion 53, a soldering portion 55 which extends from the other end of the contact portion 53, a connect portion 56 which extends from the soldering portion 55 and a block portion 57 which extends from the end of the connect portion 56.

After the process of assembling, the preload portion 54 is held under the block portion 57, the prepressing is sustained by the contact 5 itself, the prepressing will not exert on the insulative housing 4 directly. This is helpful to prevent the deformation of the insulative housing 4.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

While preferred embodiment in accordance with the present invention have been shown and described, equivalent modifications and changes known to persons skilled in the art according to the spirit of the present invention are considered within the scope of the present invention as defined in the appended claims.

What is claimed is:

1. An electrical card connector comprising an insulative housing and a plurality of contacts received in the insulative housing, each contact including an elastic portion and a soldering portion with an elongated planar retention portion defined therebetween, a connecting portion extending upwardly from a distal end of the soldering portion, the connecting portion defining a block portion parallel with the retention portion on a distal end, a curved contact portion extending from the elastic portion toward the block portion, and a preload portion defined on the contact portion extending beyond the block portion under a free condition when no card loaded, wherein the preload portion abuts against an underside of the block portion after assembling the contact into the insulative housing.

2. The electrical connector as recited in claim 1, wherein the insulative housing defines an assembly surface and a contact surface locating against the assembly surface, a plurality of passageways are defined between and extends through the assembly surface and the contact surface, the contacts are all received in the passageways except the contact portion and the soldering portion.

3. The electrical connector as recited in claim 1, wherein the soldering portion is parallel with the block portion.

4. The electrical connector as recited in claim 1, wherein the contacts locate against each other in a longitude direction correspondingly.

5. An electrical connector for use with an electronic card, comprising:

an insulative housing defining a plurality of horizontal passageways each extending upwardly through an upper mating face of the housing and sideward through a side face of the housing;

a plurality of contacts disposed in the corresponding passageways via being assembled into the corresponding passageways from the corresponding side face, respectively, each of said contacts including an inner main horizontal retention portion and an outer solder portion, a contacting section indirectly extending from the retention portion and above the mating face and a blocking portion indirectly extending from the solder portion toward each other under a condition that a distal end of the contacting section defines a preload portion abutting against an underside of the blocking portion so as to form a loop like configuration when no card is loaded.

6. The electrical connector as claimed in claim 5, wherein said housing further includes a supporting plate under each passageway on which the retention portion of the contacts is seated.

7. The electrical connector as claimed in claim 5, wherein said solder portion is downwardly offset from the retention portion.

8. The electrical connector as claimed in claim 5, wherein said contacting section extends from the retention portion via a curved portion.

9. The electrical connector as claimed in claim 5, wherein said blocking portion extends from the solder portion via a connection portion.

10. The electrical connector as claimed in claim 9, wherein said connection portion faces toward an exterior via said side face.

11. The electrical connector as claimed in claim 5, wherein said block portion is located around the mating face.

* * * * *